US011952793B1

(12) United States Patent
Johns

(10) Patent No.: US 11,952,793 B1
(45) Date of Patent: Apr. 9, 2024

(54) UMBRELLA AND PORTABLE STAND

(71) Applicant: Stephen Johns, Merritt Island, FL (US)

(72) Inventor: Stephen Johns, Merritt Island, FL (US)

( * ) Notice: Subject to any disclaimer, the term of this patent is extended or adjusted under 35 U.S.C. 154(b) by 0 days.

(21) Appl. No.: 18/110,127

(22) Filed: Feb. 15, 2023

(51) Int. Cl.

| | |
|---|---|
| ***E04H 12/22*** | (2006.01) |
| ***A47B 23/02*** | (2006.01) |
| ***A47B 37/04*** | (2006.01) |
| ***A47G 23/02*** | (2006.01) |

(52) U.S. Cl.
CPC ..... *E04H 12/2246* (2013.01); *A47B 23/02* (2013.01); *A47B 37/04* (2013.01); *A47G 23/0208* (2013.01); *A47B 2220/0008* (2013.01)

(58) Field of Classification Search
CPC ..... A47B 37/04; A47B 5/02; A47B 23/02; A47B 23/04; A47B 2220/0008; E04H 12/2246; A47G 23/0208
USPC ..... 248/910, 519
See application file for complete search history.

(56) References Cited

U.S. PATENT DOCUMENTS 2,123,257 A * 7/1938 Provost ..... B60N 3/002 40/563
2,190,222 A * 2/1940 Strasser ..... A47B 37/04 248/156
3,036,717 A * 5/1962 Johnson ..... B60N 3/103 224/482
3,395,692 A * 8/1968 Johns ..... A47J 37/0763 126/30
3,624,732 A * 11/1971 Bowden ..... A47B 37/04 108/151
5,228,148 A 7/1993 Weir
5,333,322 A 8/1994 Weir
5,427,346 A * 6/1995 Urgola ..... A45C 9/00 248/910
5,505,645 A * 4/1996 Engler, Jr. ..... A63B 67/007 135/16
5,572,750 A 11/1996 Johnston
5,760,751 A * 6/1998 Gipson ..... H01Q 1/1235 343/890
5,803,265 A * 9/1998 Bergerman ..... A47B 23/02 206/557
5,829,723 A * 11/1998 Brunner ..... A61M 5/1415 248/222.13
5,996,511 A * 12/1999 Swoger ..... A47B 57/26 108/151

(Continued)

*Primary Examiner* — Taylor Morris
(74) *Attorney, Agent, or Firm* — Brian S. Steinberger; Hilary F. Steinberger; Law Offices of Brian S. Steinberger, P.A.

(57) ABSTRACT

Pool stands, trays, devices, and methods for supporting beverage containers on the edge of a swimming pool while supporting a pool umbrella. One embodiment of the stand can be generally disc shaped with a lower front step portion, and a through-hole passing through the stand to allow an umbrella post to be supported therein. A clamping screw knob can lock the umbrella post to the stand. The stand can be positioned on the edge of a swimming pool so that shade from the umbrella can be provide to person(s) in the pool. Another embodiment can have a generally rectangular configuration with a lower front step portion that can also be positioned on the edge of a swimming pool so that shade from the umbrella can be provided to person(s) in the pool. The interior of the stands can be hollow, and can be filled with a ballast, such as sand or water.

15 Claims, 21 Drawing Sheets

(56) References Cited

U.S. PATENT DOCUMENTS 6,061,850 A * 5/2000 Roper, III ..... A45C 3/10 248/539
6,101,955 A * 8/2000 Salce ..... B65D 19/38 248/346.02
6,138,966 A * 10/2000 Smith ..... G11B 33/02 248/176.1
6,139,382 A * 10/2000 Eschbacher ..... B63B 22/24 441/32
6,354,554 B1 * 3/2002 Hollenbeck ..... E04H 12/2246 248/156
6,474,244 B1 11/2002 Karpinski
6,554,012 B2 * 4/2003 Patarra ..... A45B 3/00 62/331
6,676,094 B1 * 1/2004 Brown ..... F16M 13/022 248/539
6,796,319 B1 * 9/2004 Patarra ..... A45C 11/20 108/138
6,862,755 B1 3/2005 Crachy
6,889,618 B1 * 5/2005 Gromack ..... A47B 13/088 108/151
6,931,998 B1 * 8/2005 Leese ..... A47B 5/02 108/42
6,976,434 B2 * 12/2005 Roig ..... B63B 22/24 108/25
7,386,896 B2 * 6/2008 Spicer ..... E04H 4/14 4/496
8,381,662 B2 * 2/2013 Goldszer ..... A47B 37/04 135/16
8,393,343 B2 * 3/2013 VanVonderen ..... E04F 10/04 135/98
8,397,648 B1 * 3/2013 Palladino ..... A47B 37/04 108/42
9,150,235 B2 * 10/2015 Galante ..... B62B 5/0013
9,192,214 B2 * 11/2015 Gambill ..... A45B 23/00
9,220,337 B1 * 12/2015 Wenzel ..... A47B 13/023
9,392,868 B2 * 7/2016 Nardi ..... A47B 13/16
9,463,850 B2 * 10/2016 Lovett ..... A45B 25/00
9,655,437 B2 * 5/2017 Clause ..... A47B 13/16
9,661,917 B2 * 5/2017 Dias ..... A47B 13/003
9,706,820 B1 * 7/2017 Lopez ..... E04H 12/2223
10,272,976 B1 * 4/2019 Newhall ..... A47G 23/0241
11,311,103 B1 * 4/2022 Wilson ..... A47B 9/00
11,401,011 B2 8/2022 Johns
2004/0077235 A1 * 4/2004 Cloutier ..... B63B 34/50 114/363
2005/0039639 A1 * 2/2005 Espenschied ..... A47B 23/002 108/25
2005/0241546 A1 * 11/2005 Royse ..... A47B 37/04 224/521
2006/0017354 A1 * 1/2006 DeMars ..... A47F 9/00 312/50
2009/0000523 A1 * 1/2009 Ciardelli ..... A47B 37/04 108/42
2011/0185491 A1 8/2011 Roberts
2012/0118902 A1 * 5/2012 Beltrante ..... B65D 11/08 220/737
2014/0102337 A1 * 4/2014 Ralph ..... A47B 13/16 108/42
2015/0000716 A1 * 1/2015 LeAnna ..... E04H 12/2284 248/514
2015/0208634 A1 * 7/2015 Box ..... A47B 88/00 108/25
2018/0249838 A1 * 9/2018 Melaragno ..... A47B 5/04
2018/0298929 A1 * 10/2018 Lund ..... F16B 9/02
2021/0145169 A1 * 5/2021 Schwiebert ..... A45B 23/00
2022/0133070 A1 * 5/2022 Colin ..... F16B 2/08 248/227.3
2022/0268049 A1 8/2022 Frerich
2023/0064396 A1 * 3/2023 Foley ..... A47B 37/04

* cited by examiner

UMBRELLA AND PORTABLE STAND

FIELD OF INVENTION

This invention relates to swimming pool accessories, and in particular to stands, trays, devices, and methods for supporting beverage containers on the edge of a swimming pool while supporting a pool umbrella.

BACKGROUND AND PRIOR ART

Swimming pools are popular locations for people in the pools to stand and socialize.

Thus, the need exists for solutions to the above problems with the prior art. Often it is enjoyable to enjoy a beverage while in the pool. However, balancing a liquid container such as a can, bottle and glass on the edge of a pool is not desirable, since the liquid in the beverage container can easily spill out.

Floating chairs have become popular for having a beverage holder in the armrest. However, the user must be seated in the chair to use the beverage holder, which is not always available or desirable.

Still furthermore, the floating chairs do not provide any shade for the user.

Devices have been proposed over the years to incorporate a beverage and umbrella stand. See for example, U.S. Pat. Nos.: 5,228,148 to Weir; to Weir and 6474244 to Karpinski.

However, the Weir devices are elaborate molded seats that sit in the pool, and are large and cumbersome to use and move, and are not inexpensive to make.

Karpinski '244, requires an elaborate leg and angled support leg that extends below the tray, and is not desirable to pool users.

Additionally, the above referenced prior art devices would be expensive to manufacture and not be inexpensive to the end user. These devices would also not be desirable, since they take up substantial amounts of space in the pools when being used, and take up substantial space when being stored.

Thus, the need exists for solutions with the problems of the prior art.

SUMMARY OF THE INVENTION

A primary objective of the present invention is to provide pool stands, trays, devices, and methods for supporting beverage containers on the edge of a swimming pool while supporting a pool umbrella that is easy to use when needed.

A secondary objective of the present invention is to provide pool stands, trays, devices, and methods for supporting beverage containers on the edge of a swimming pool while supporting a pool umbrella that is inexpensive to manufacture and sell.

Preferred embodiments of the stands can include a hollow plastic base for allowing the post of an umbrella to pass there-through. The purpose is to allow the shade of the umbrella to drop closer to the surface on which the base is setting.

The main purpose of this base is to allow the shade of the umbrella to be within inches of a person in the swimming pool for allowing maximum shade.

The base can be hollow with a fill cap to allow it to be filled with water or sand for stability and ballast.

The base can have a tear drop shaped through-hole so that when the clamping screw is tightened, it forces the post into the wedge shape side of the teardrop through-hole, keeping the umbrella stable.

The clamping screw also allows the installer to raise and lower the umbrella with east. The base can have a plurality of cup holder molded into the body, along with a recess in the top and a lip on the bottom allowing the base to be stacked without sliding apart.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

FIRST EMBODIMENT CIRCULAR STAND

Figure 1A:
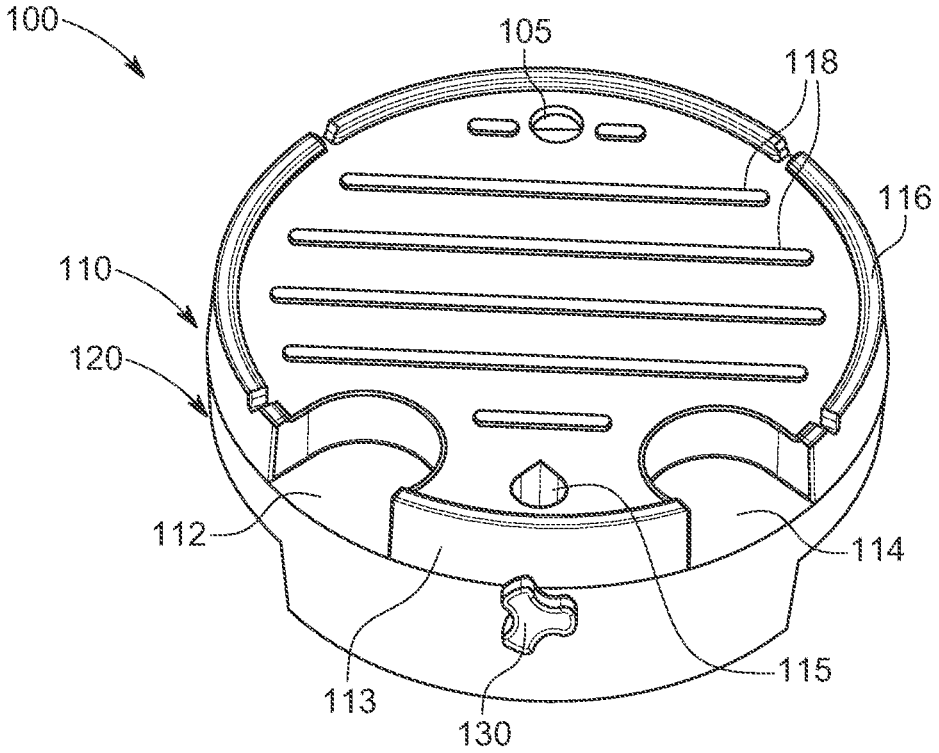
Figure 1B:
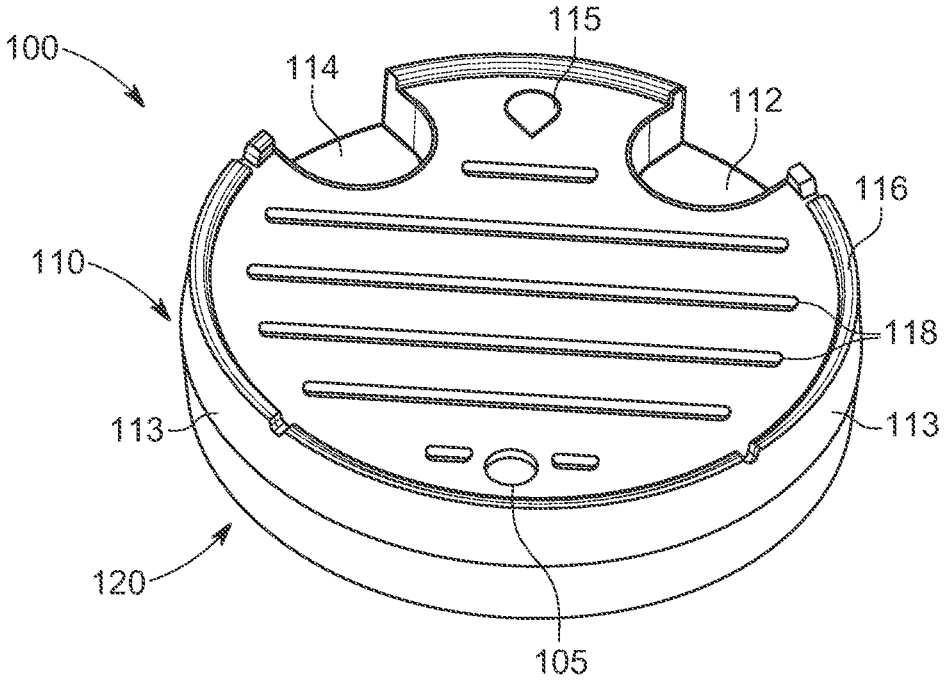

FIG. 1A is an upper front perspective view of a first embodiment stand for supporting beverage containers and a pool umbrella post FIG. 1B is an upper rear perspective view of the stand of FIG. 1A.

Figure 1C:
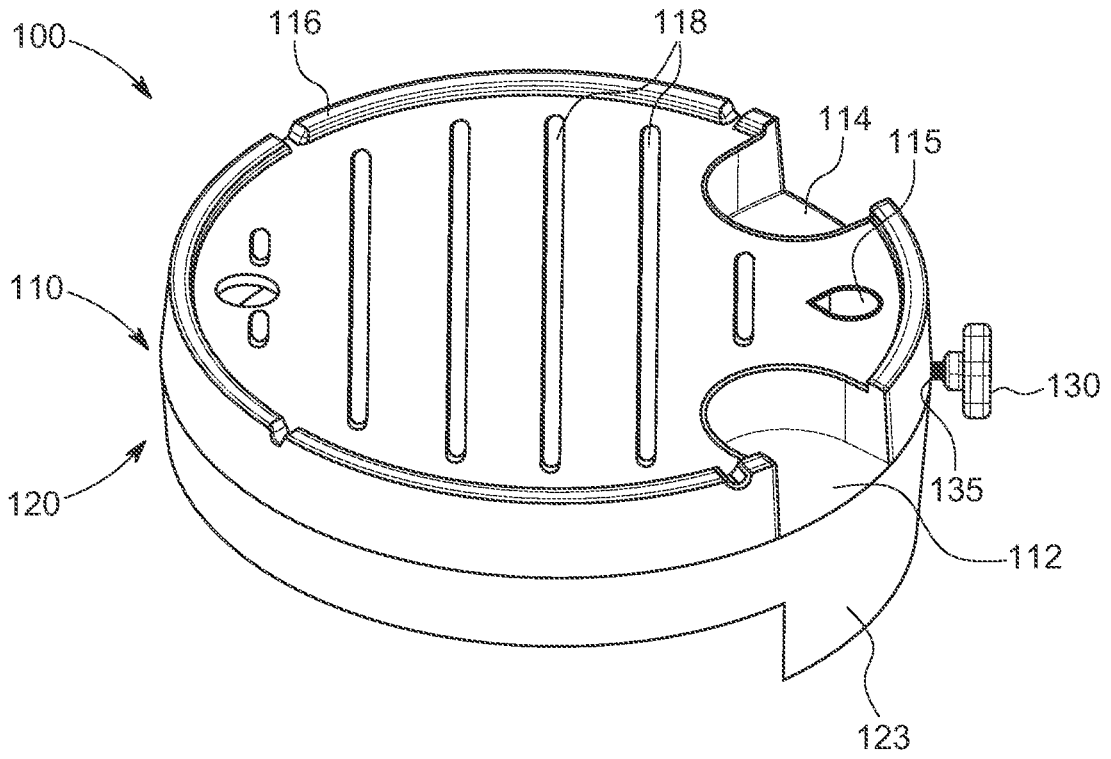

FIG. 1C is an upper left perspective view of the stand of FIG. 1A.

Figure 1D:
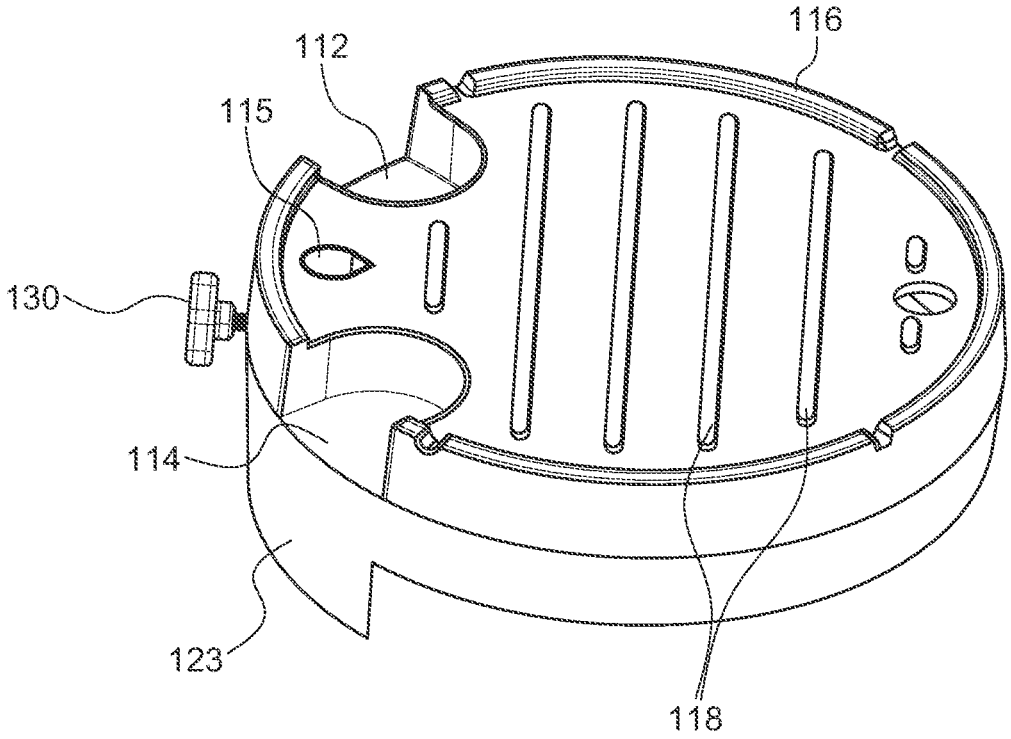

FIG. 1D is an upper right perspective view of the stand of FIG. 1A.

Figure 2A:
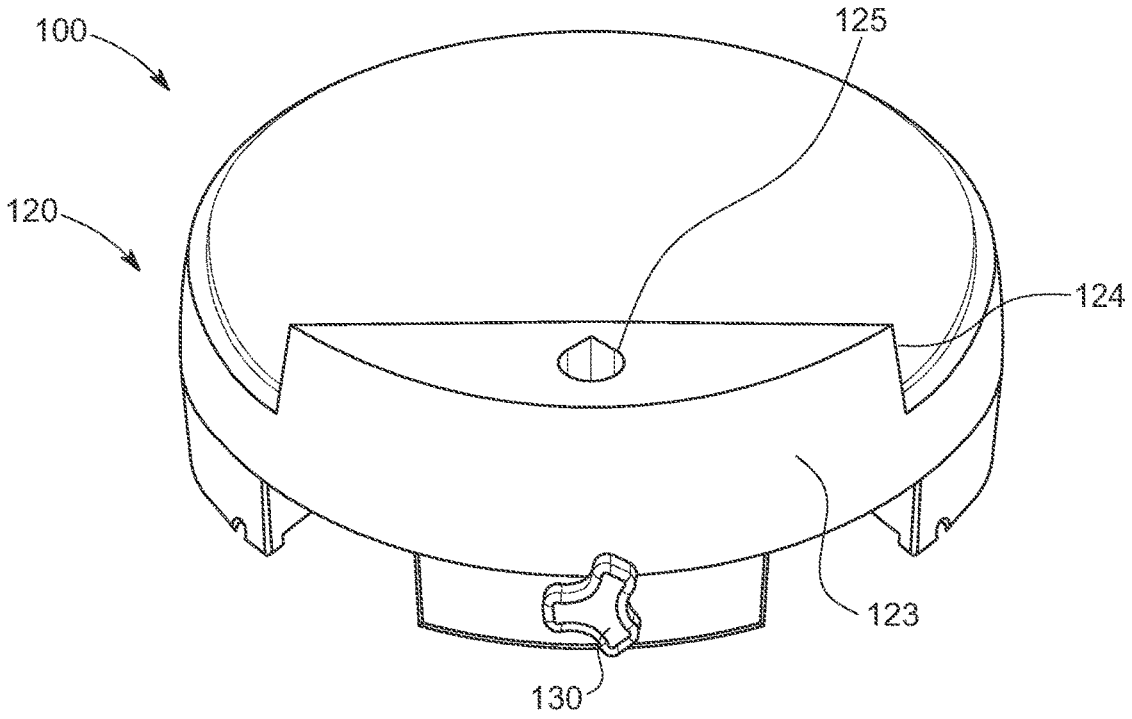

FIG. 2A is a lower front perspective view of the stand of FIG. 1A.

Figure 2B:
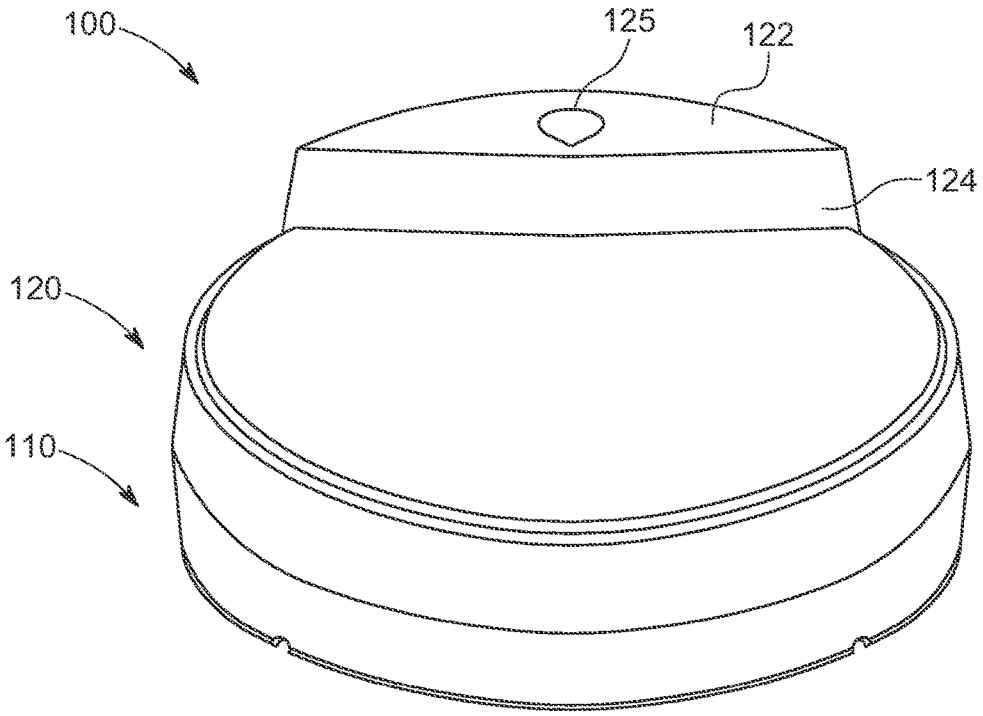

FIG. 2B is a lower rear perspective view of the stand of FIG. 1A.

Figure 2C:
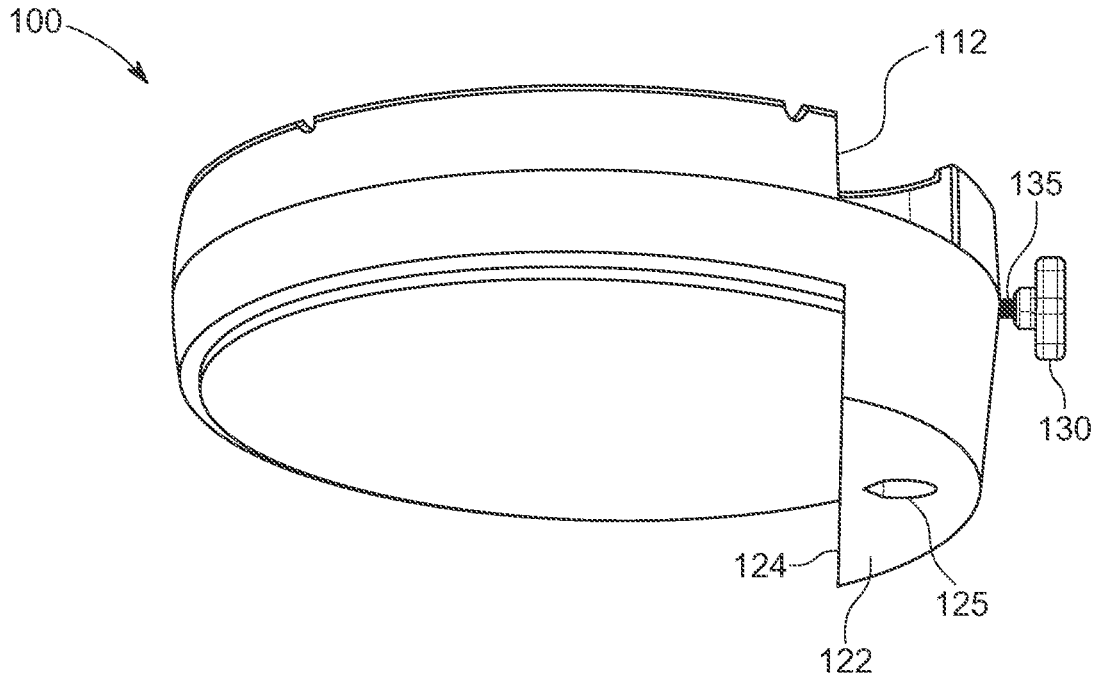

FIG. 2C is a lower left perspective view of the stand of FIG. 1A.

Figure 2D:
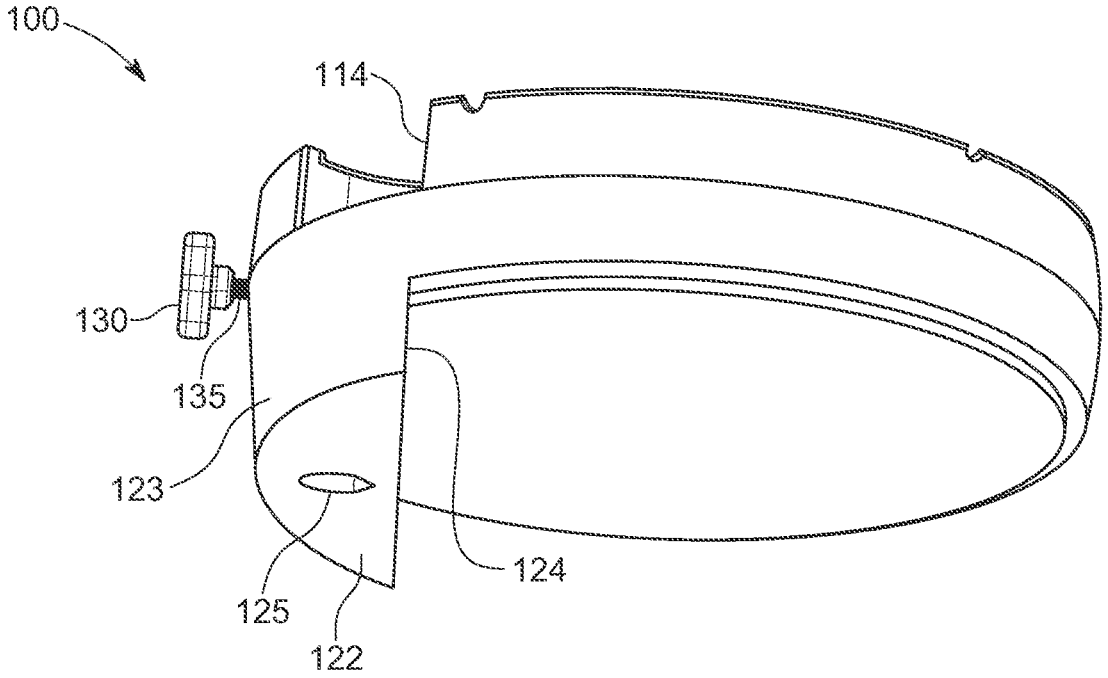

FIG. 2D is a lower right perspective view of the stand of FIG. 1A.

Figure 3A:
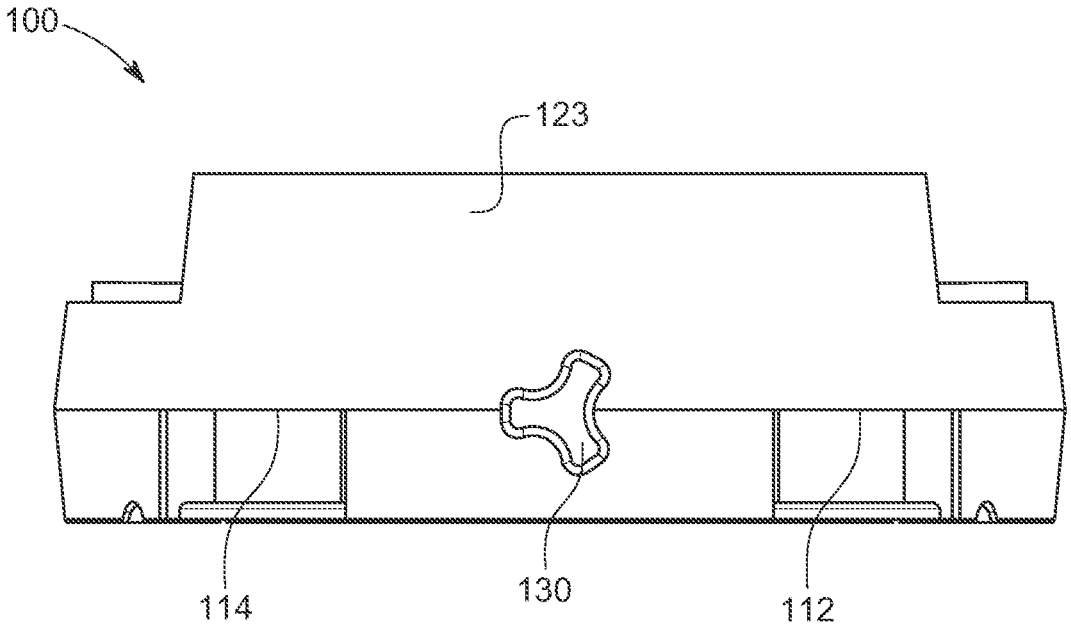

FIG. 3A is a front view of the stand of FIG. 1A.

Figure 3B:
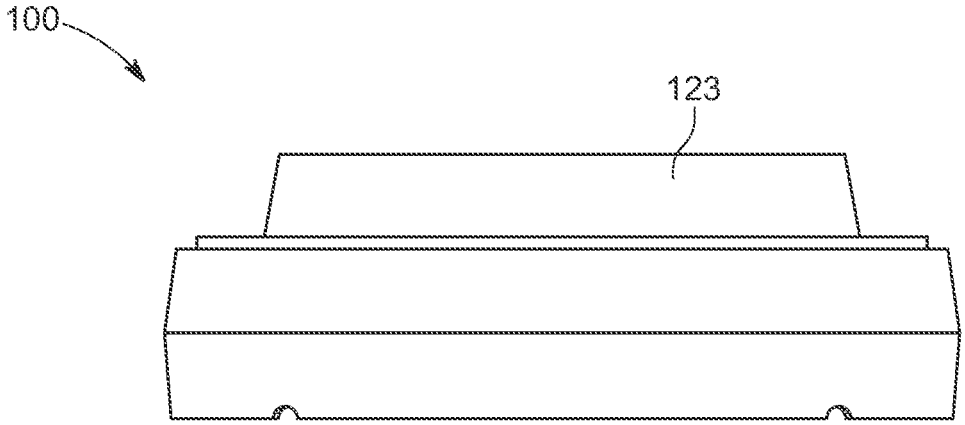

FIG. 3B is a rear view of the stand of FIG. 1A.

Figure 3C:
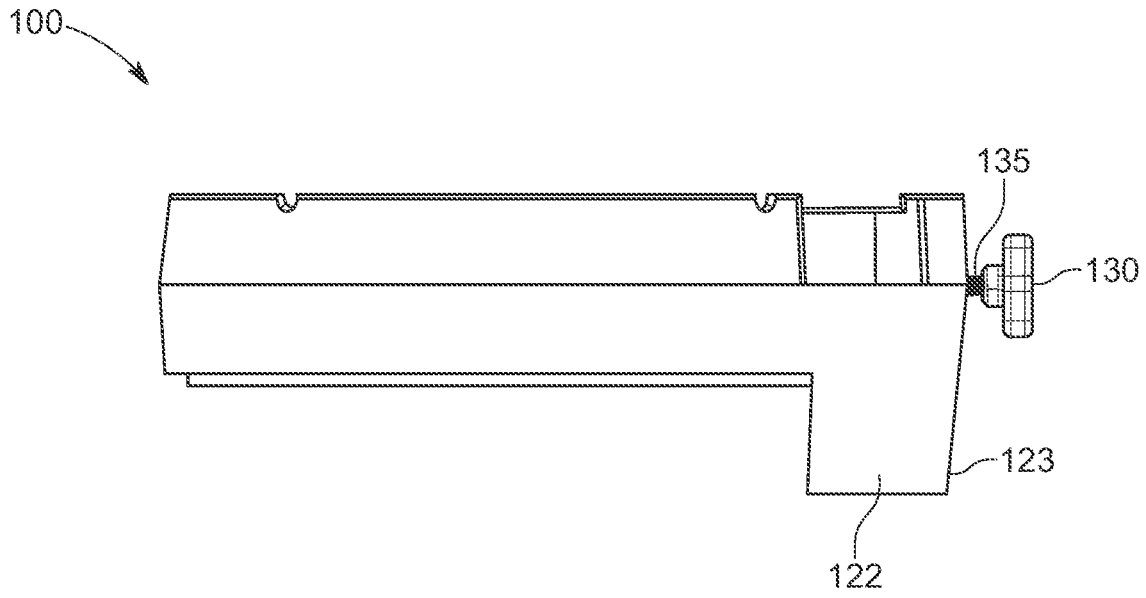

FIG. 3C is a left side view of the stand of FIG. 1A.

Figure 3D:
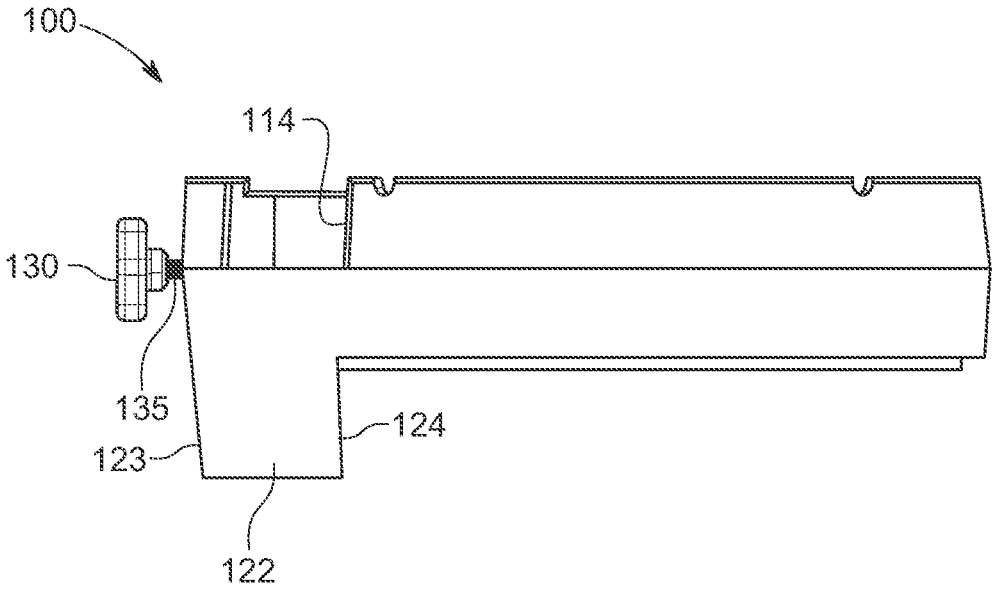

FIG. 3D is a right side view of the stand of FIG. 1A.

Figure 3E:
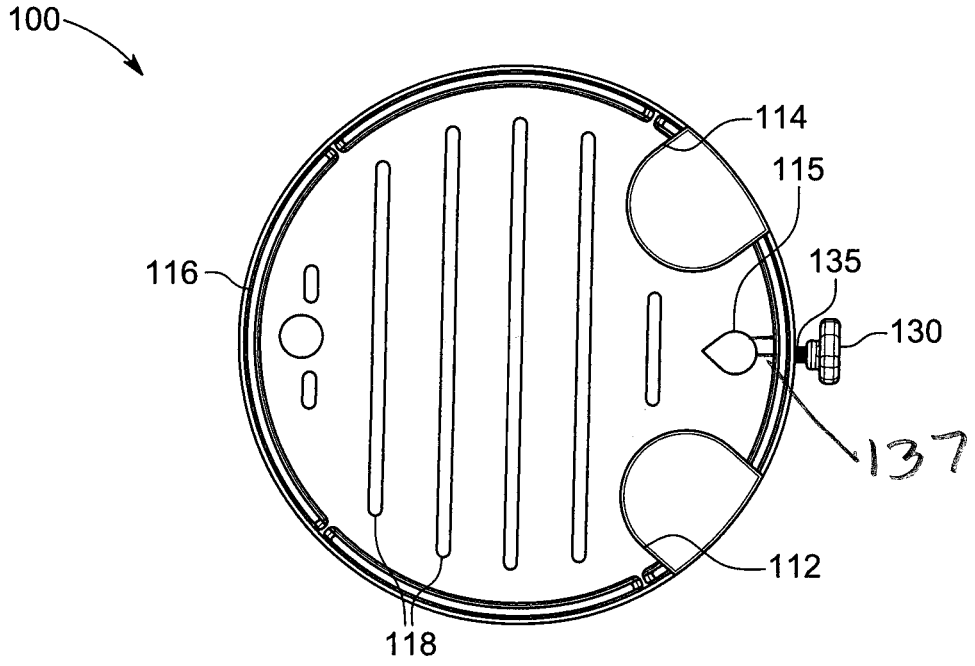

FIG. 3E is a top view of the stand of FIG. 1A.

Figure 3F:
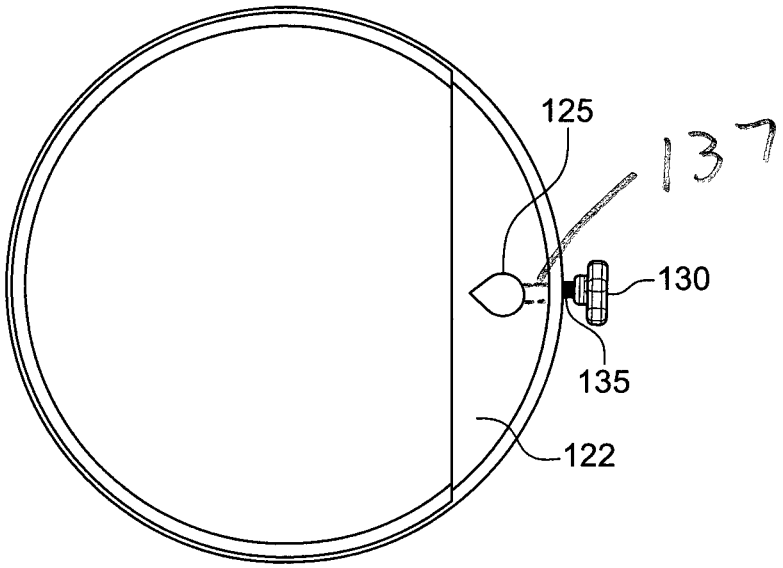

FIG. 3F is a bottom view of the stand of FIG. 1A.

Figure 4A:
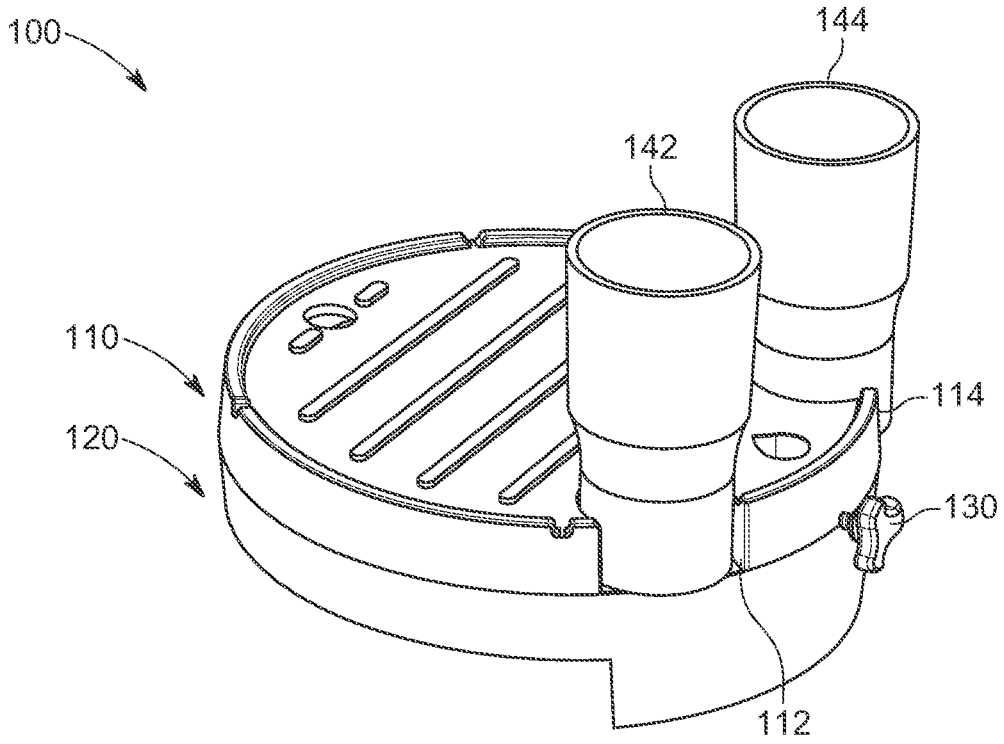

FIG. 4A is an upper front left perspective view of the stand of FIG. 1A supporting two beverage holders.

Figure 4B:
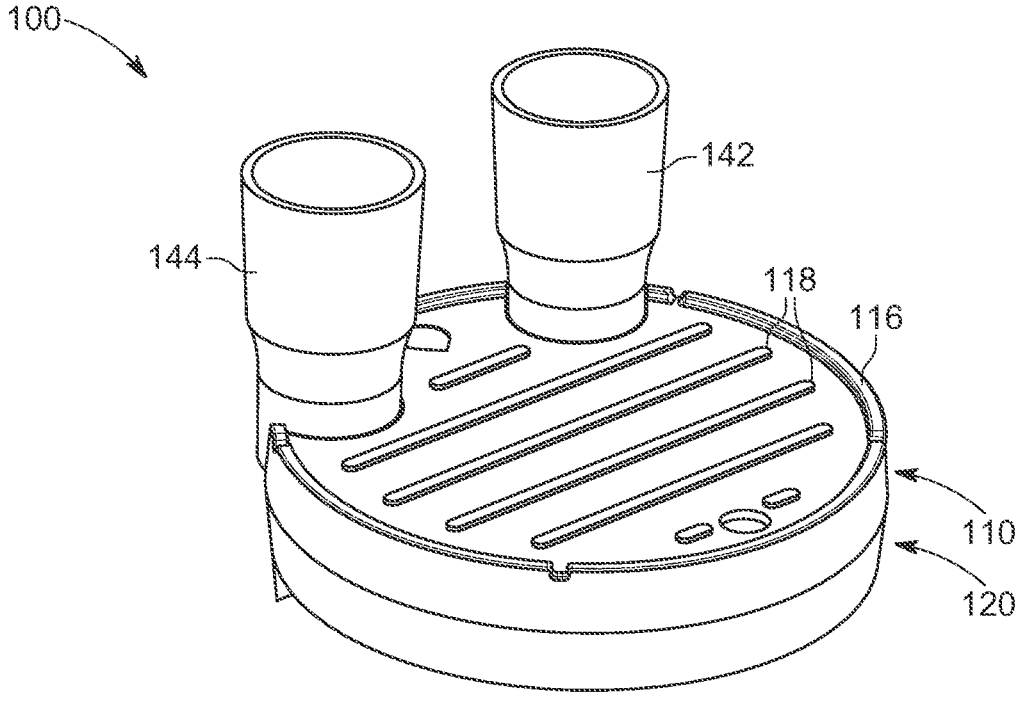

FIG. 4B is an upper rear right perspective view of FIG. 4A.

Figure 5:
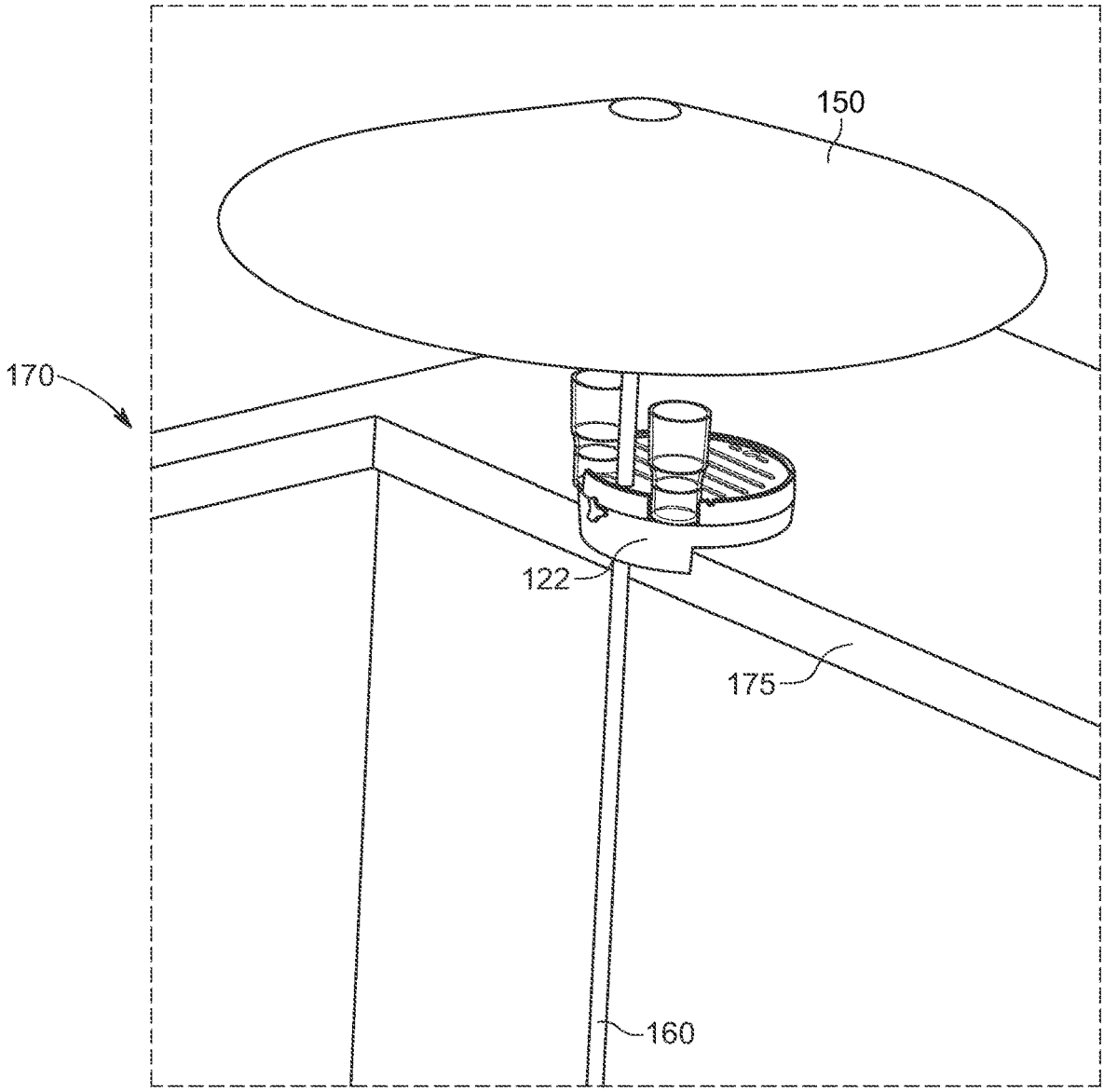

FIG. 5 is a perspective view of the stand with beverage containers of FIGS.

4A-4B supported on an edge of a swimming pool with an umbrella post clamped to the stand.

SECOND EMBODIMENT RECTANGULAR STAND

Figure 6A:
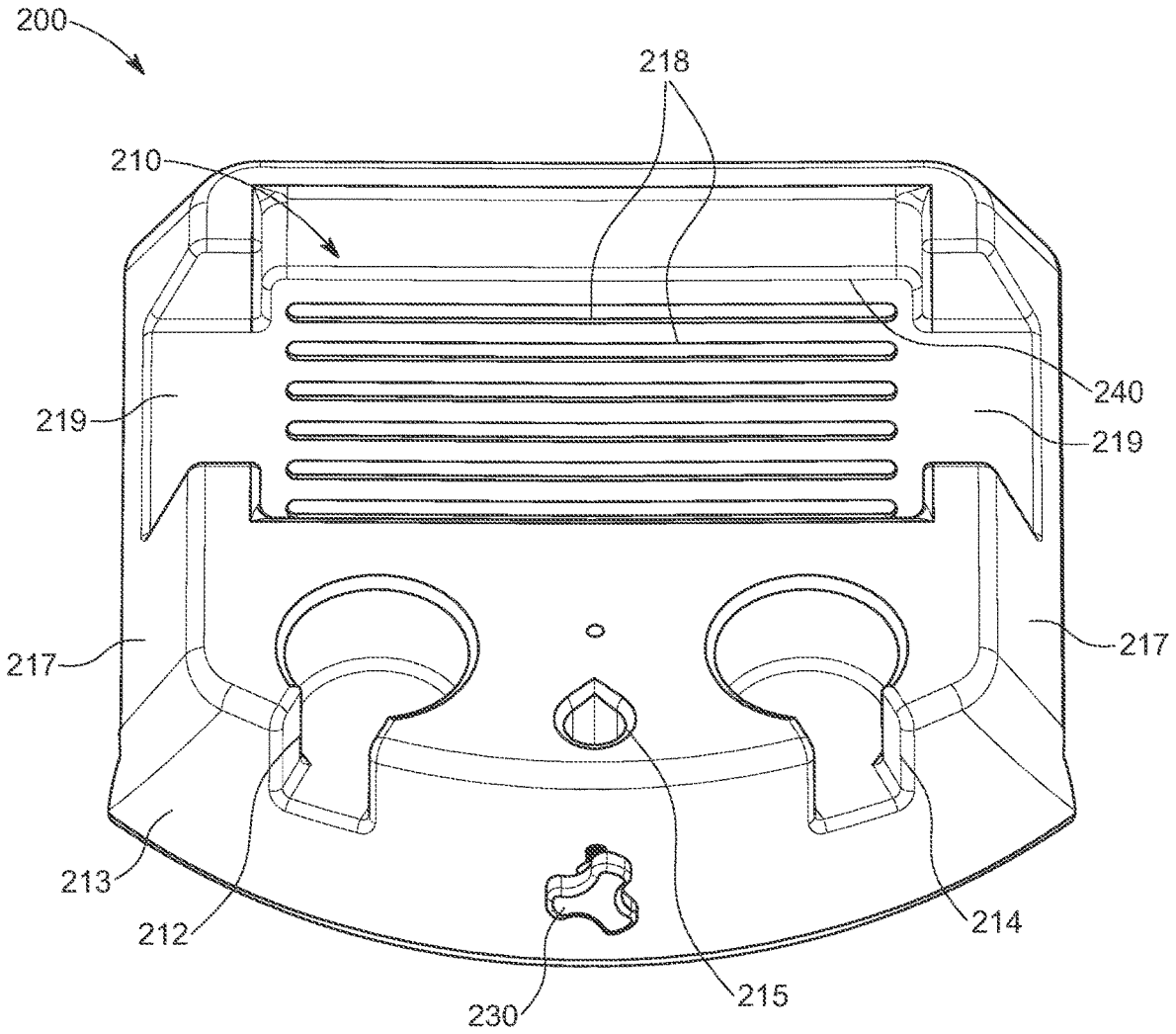

FIG. 6A is an upper front perspective view of a second embodiment stand for supporting beverage containers and a pool umbrella post.

Figure 6B:
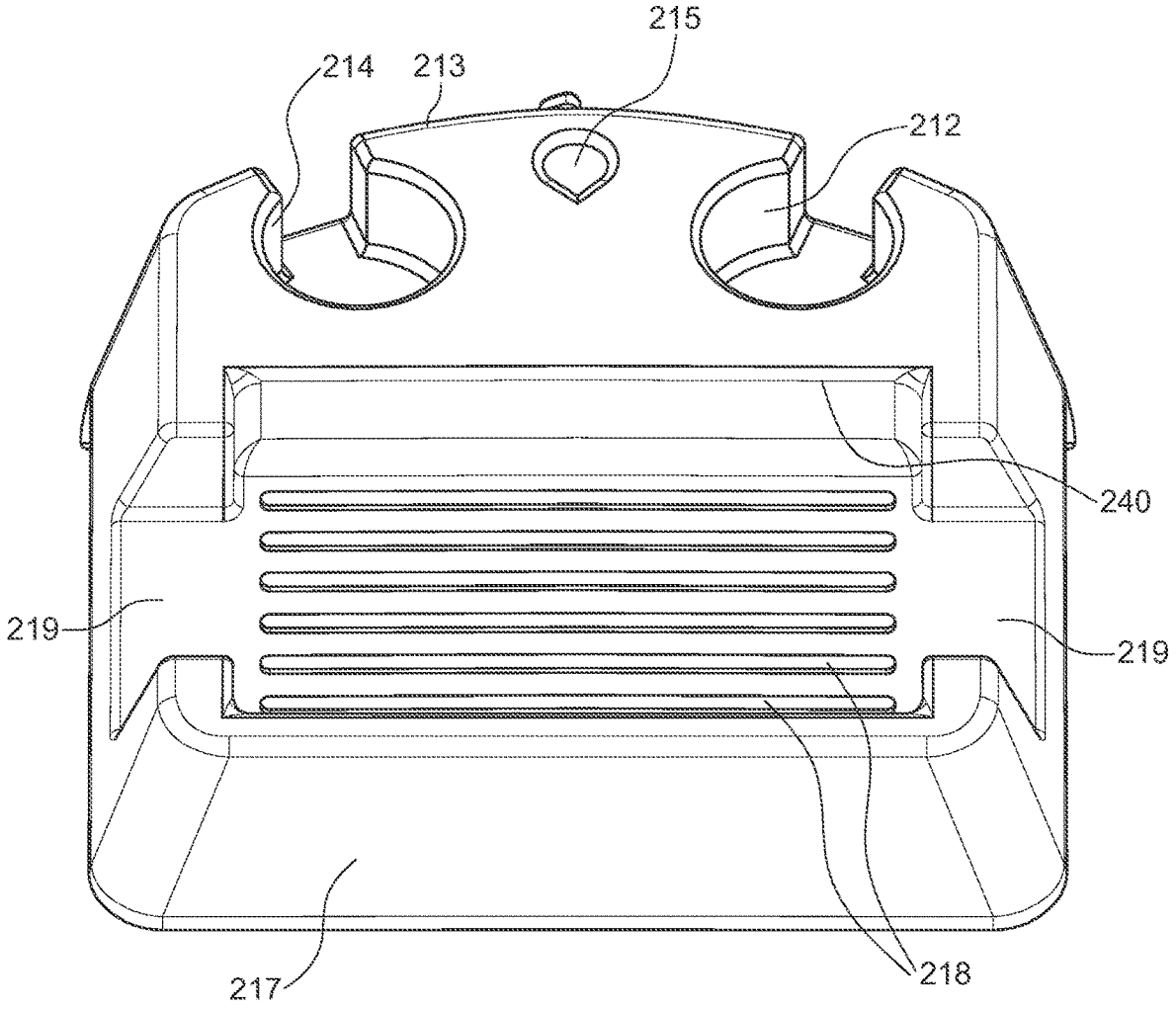

FIG. 6B is an upper rear perspective view of the stand of FIG. 6A.

Figure 6C:
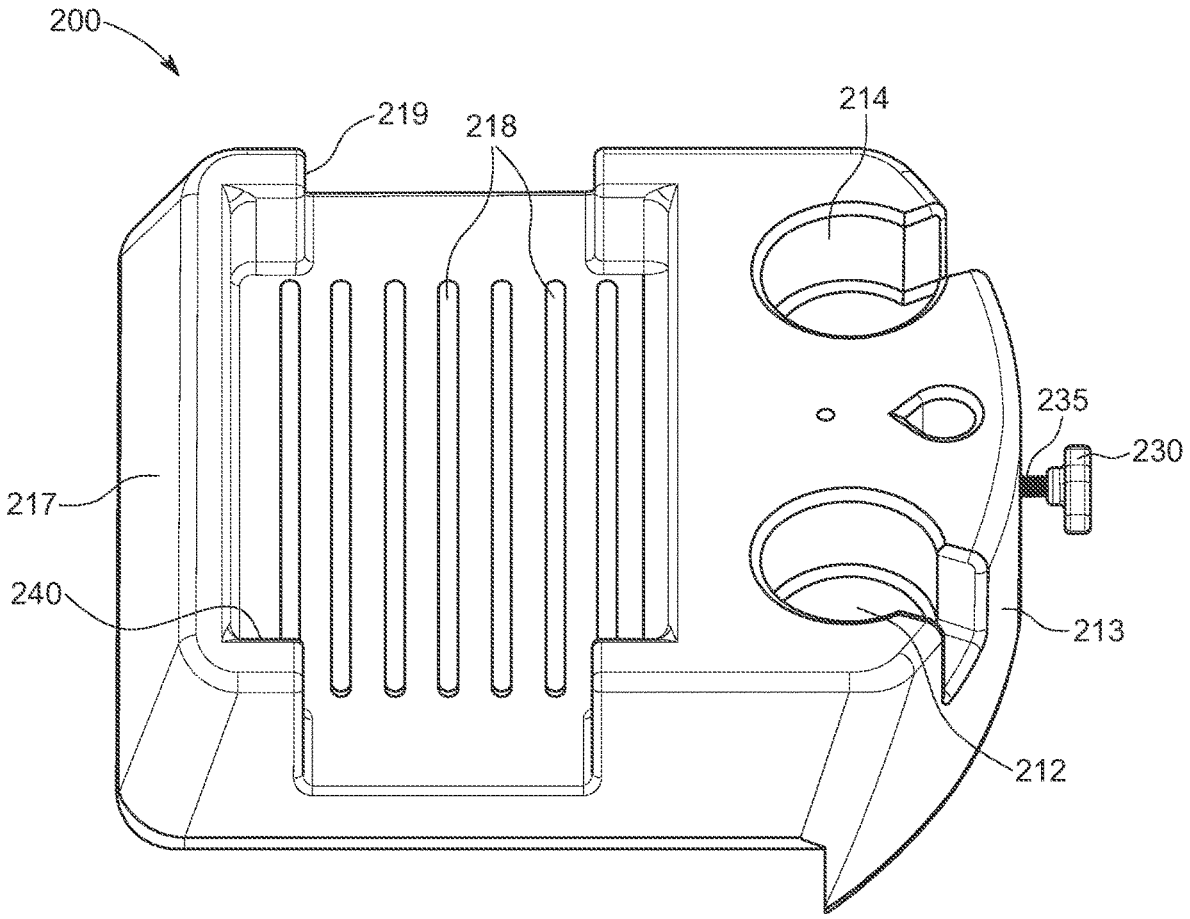

FIG. 6C is an upper left perspective view of the stand of FIG. 6A.

Figure 6D:
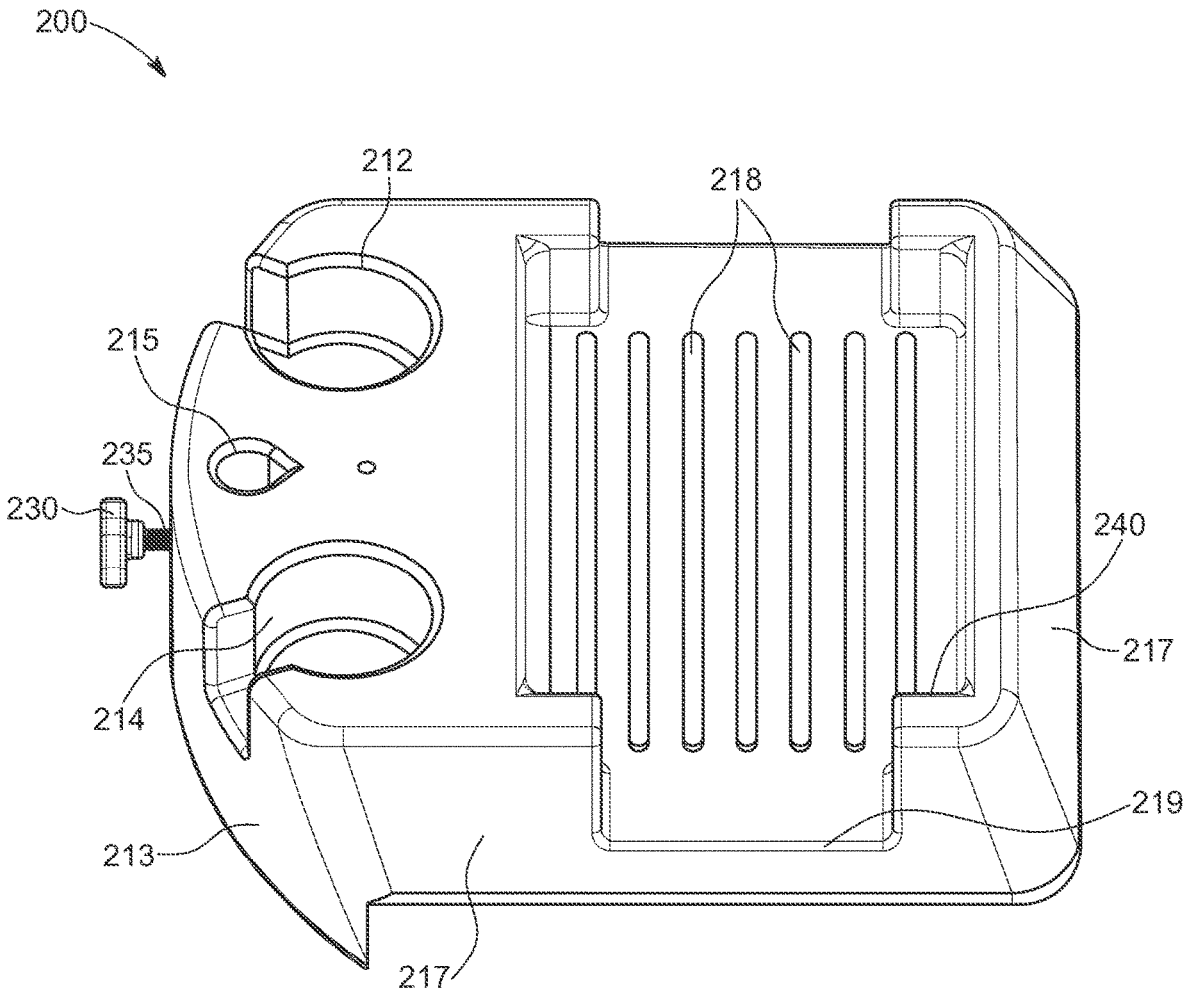

FIG. 6D is an upper right perspective view of the stand of FIG. 6A.

Figure 7A:
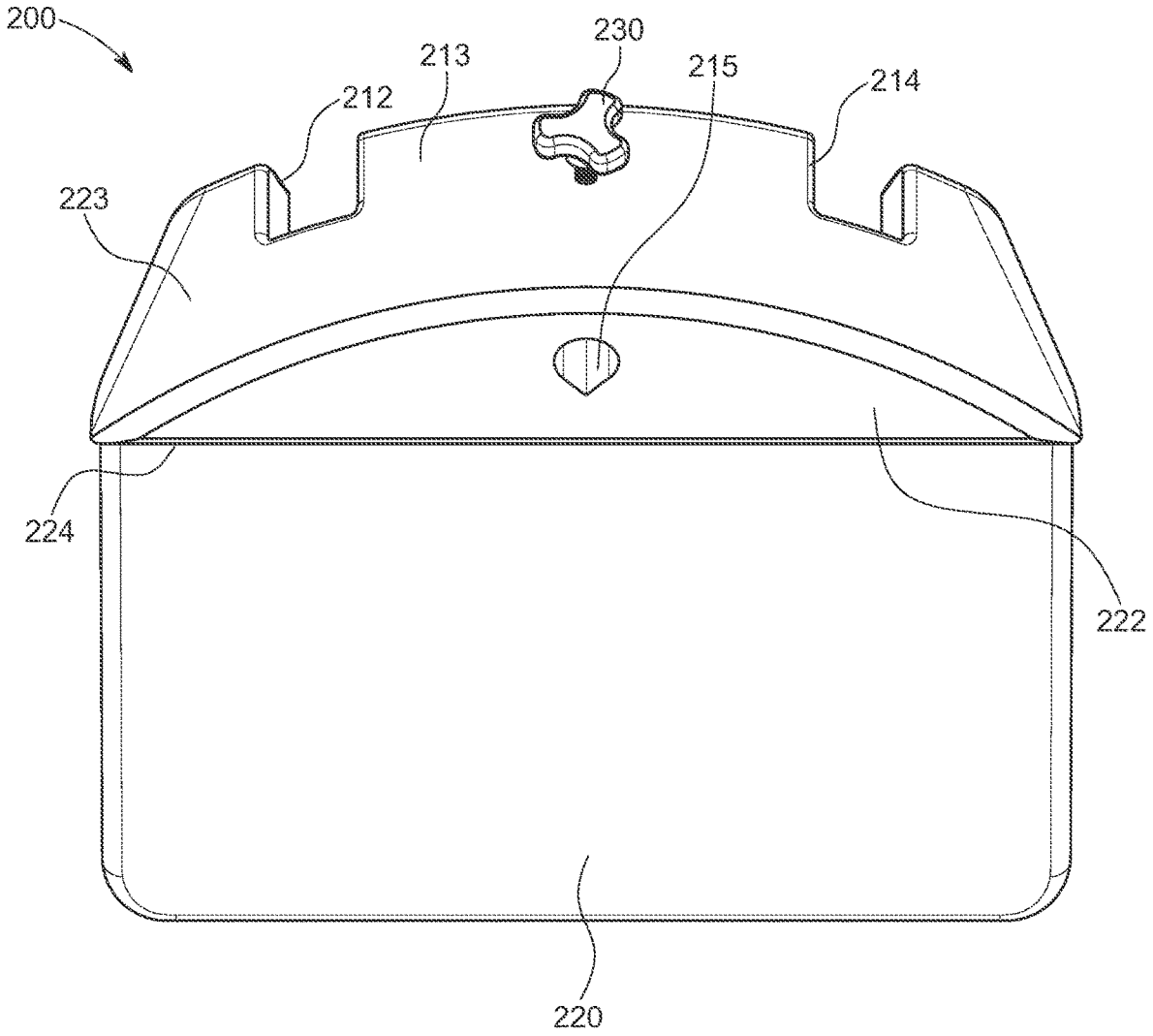

FIG. 7A is a lower front perspective view of the stand of FIG. 6A.

Figure 7B:
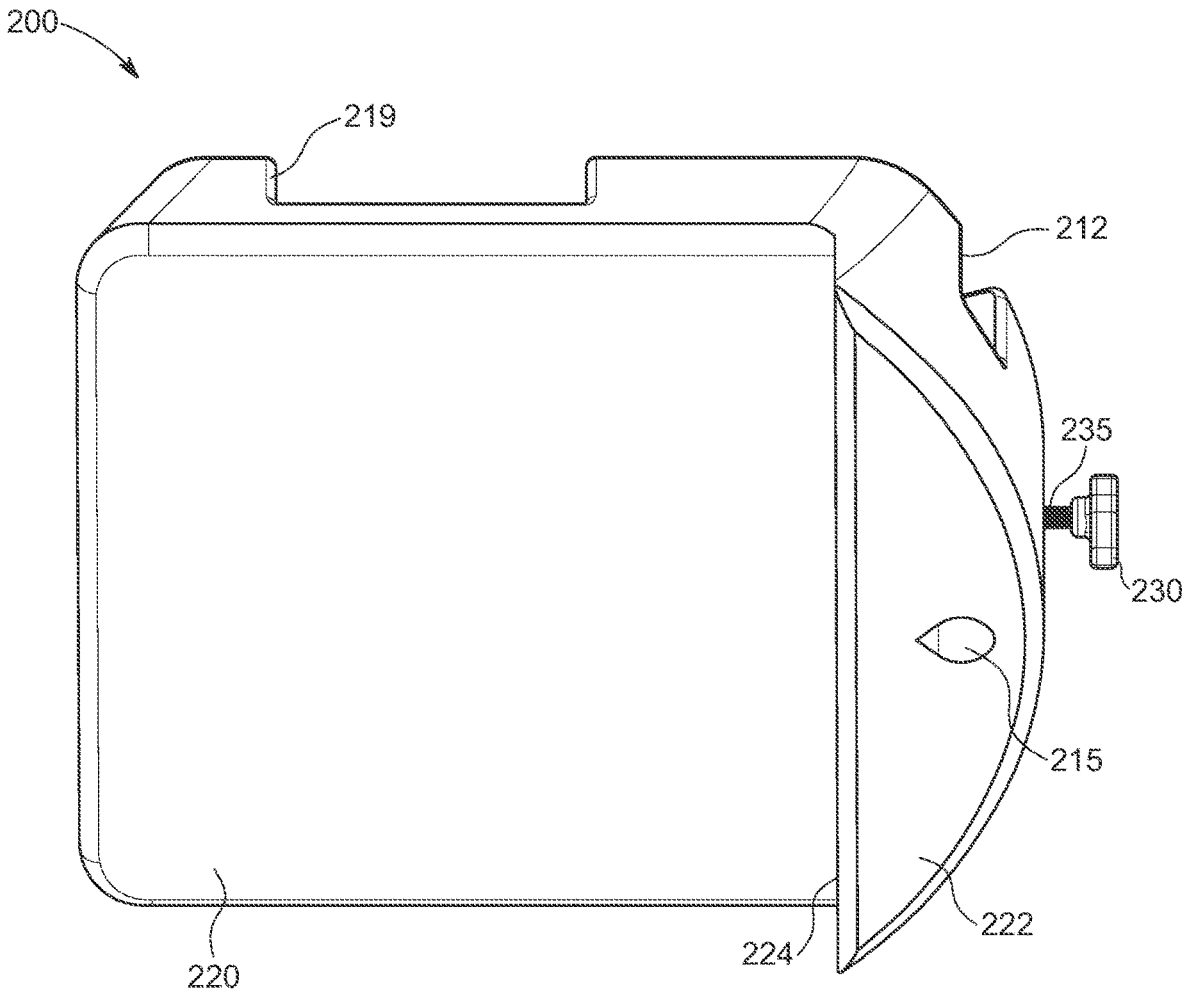

FIG. 7B is a lower left perspective view of the stand of FIG. 6A.

Figure 7C:
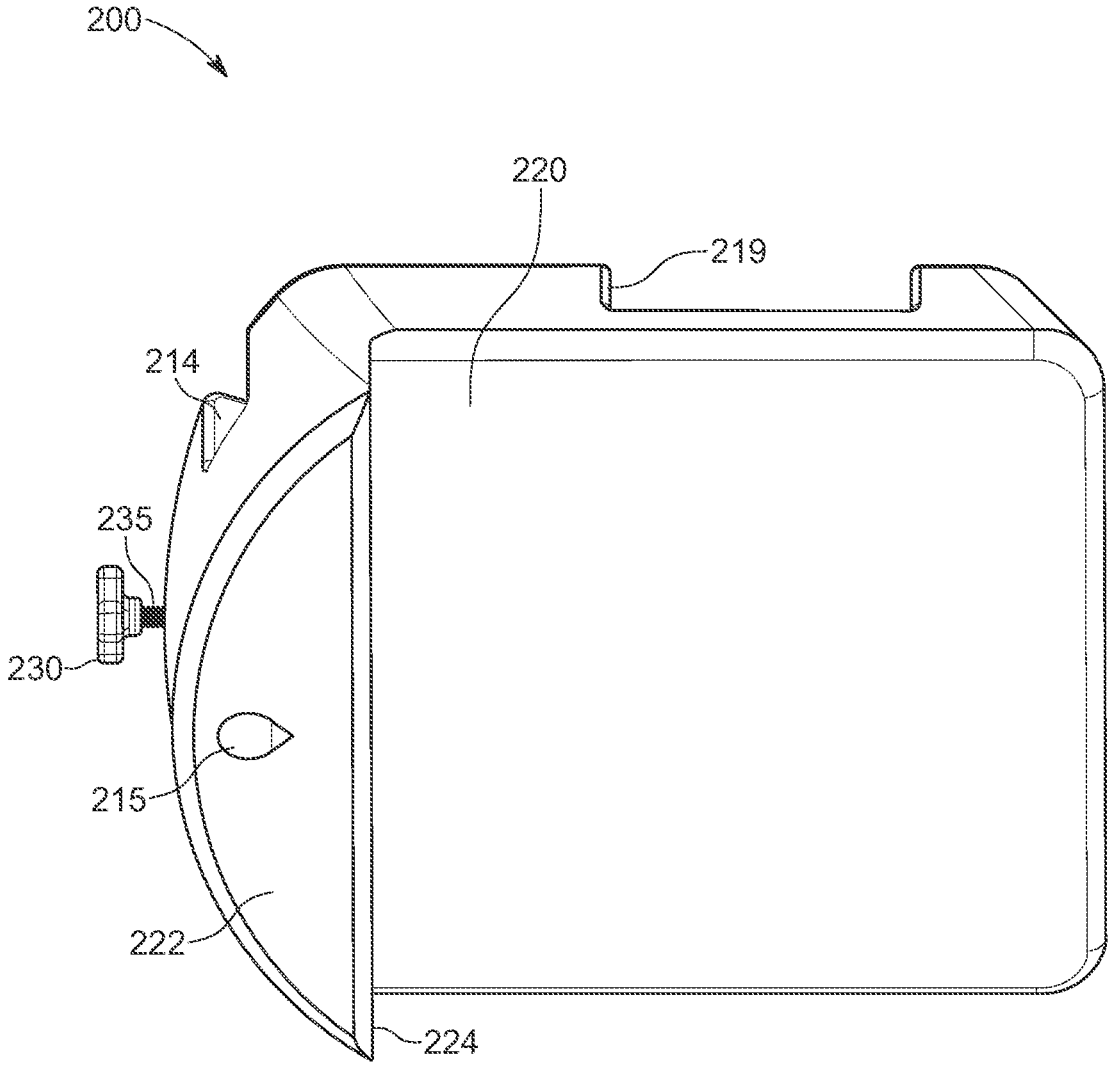

FIG. 7C is a lower right perspective view of the stand of FIG. 6A.

Figure 8A:
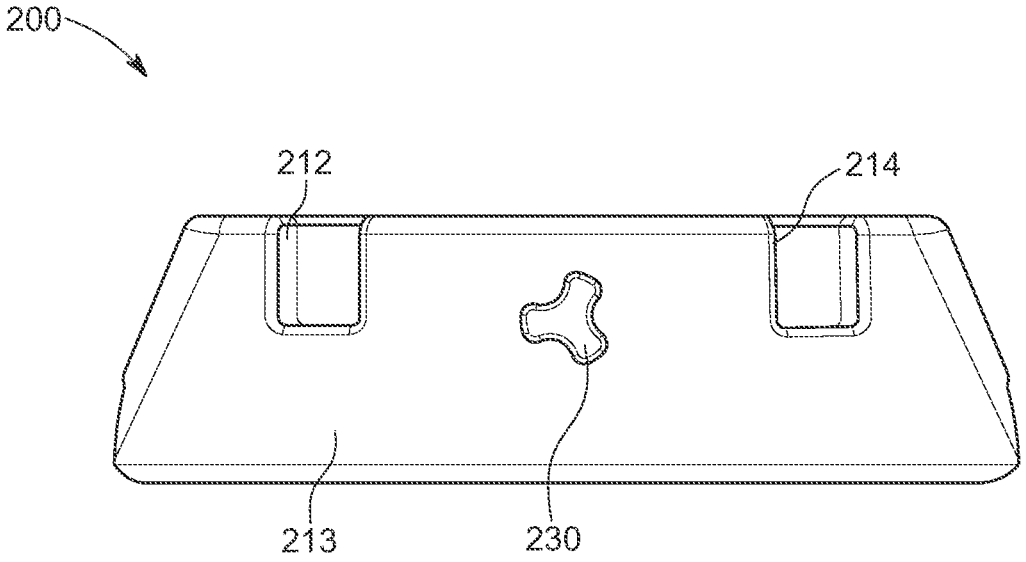

FIG. 8A is a front view of the stand of FIG. 6A.

Figure 8B:
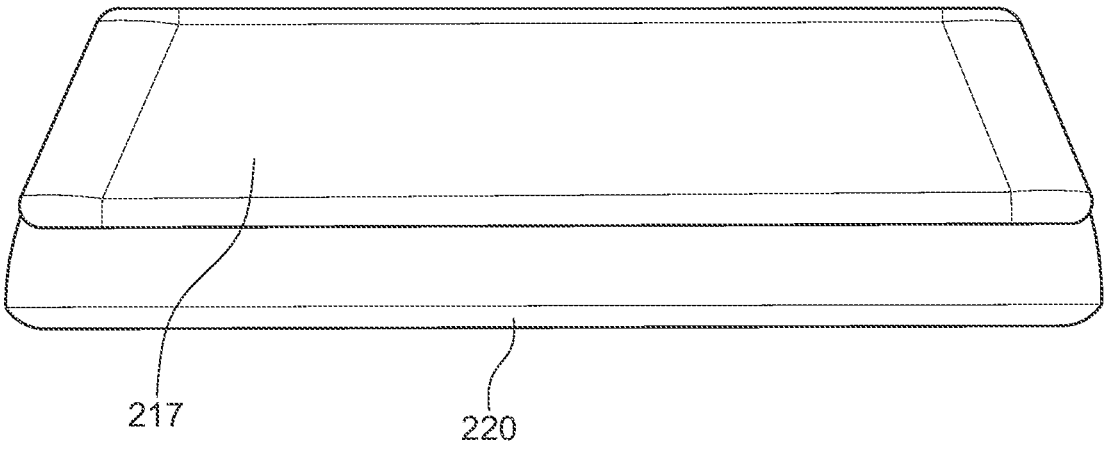

FIG. 8B is a rear view of the stand of FIG. 6A.

Figure 8C:
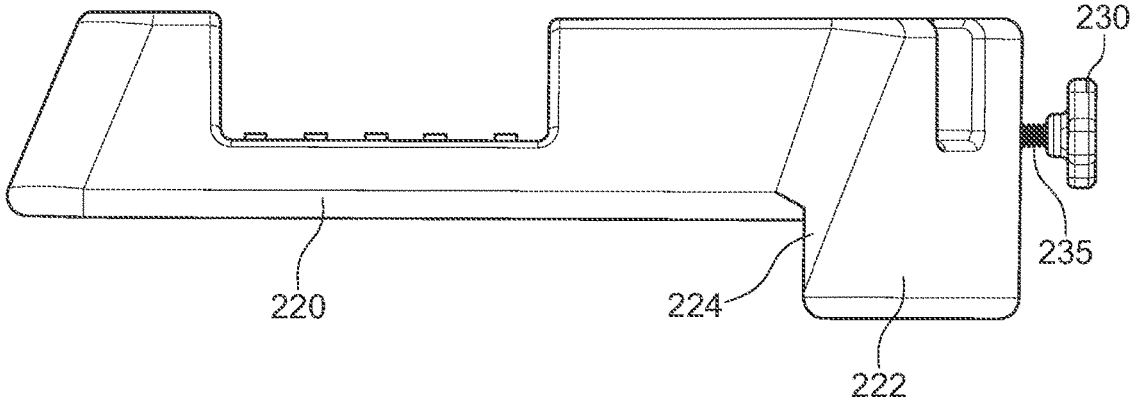

FIG. 8C is a left view of the stand of FIG. 6A.

Figure 8D:
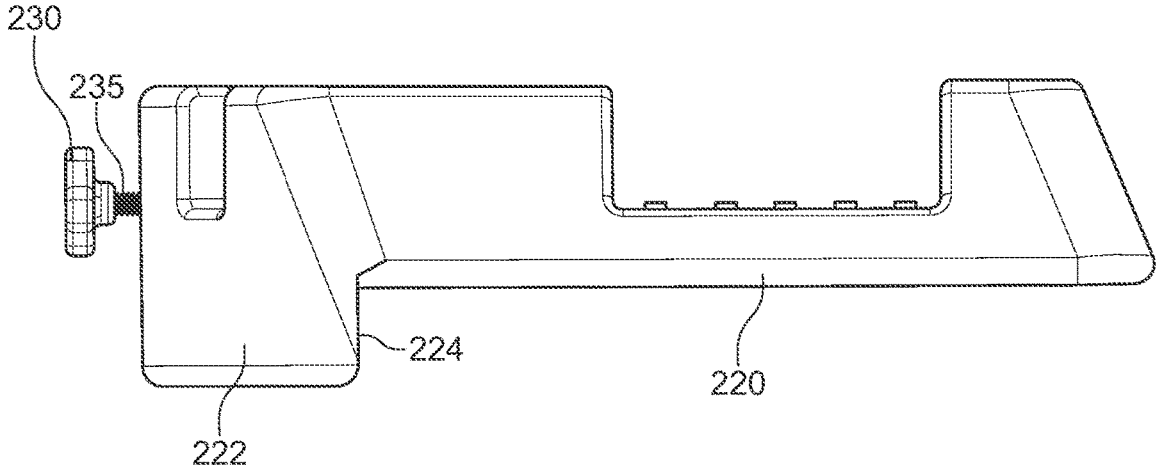

FIG. 8D is a right view of the stand of FIG. 6A.

Figure 9:
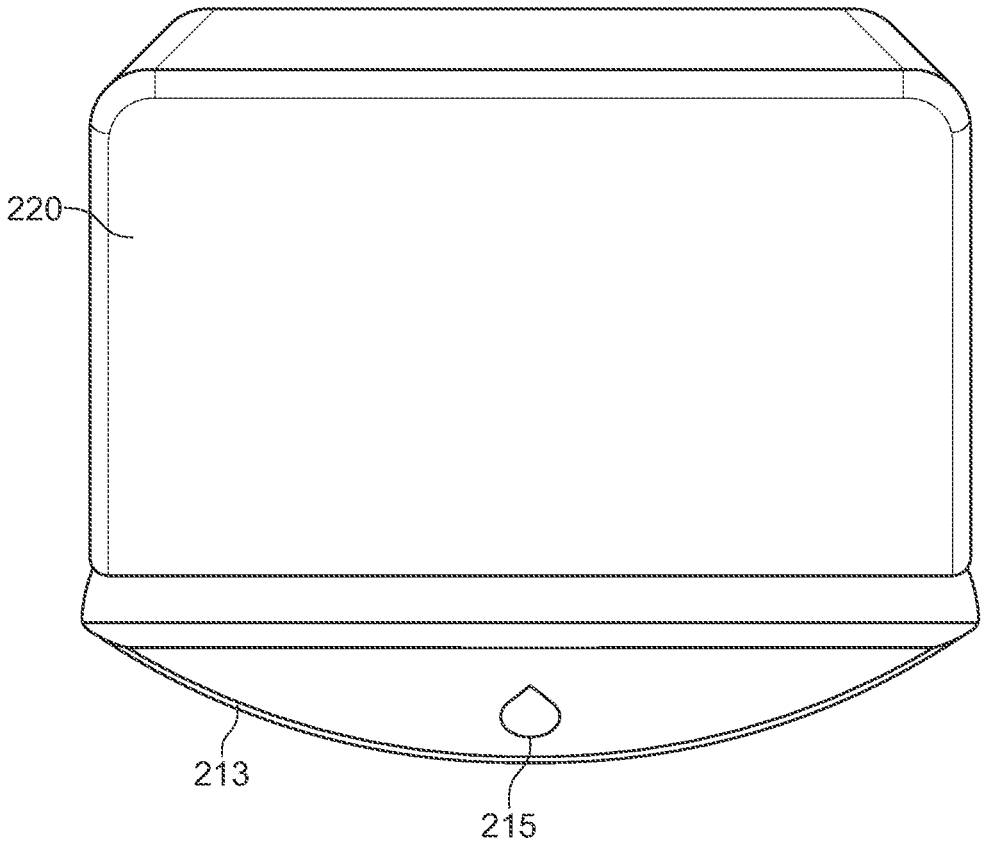

FIG. 9 is a top view of the stand of FIG. 6A.

Figure 10A:
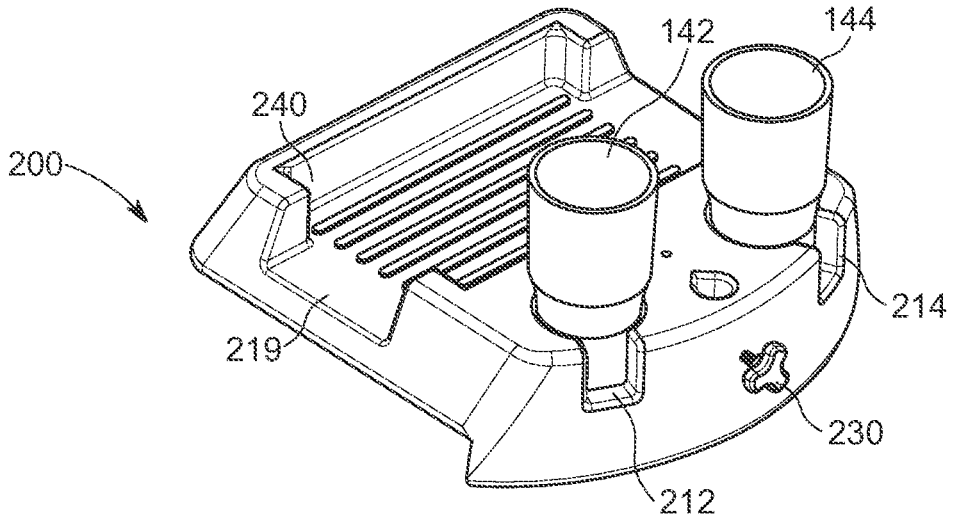

FIG. 10A is an upper front left perspective view of the stand of FIG. 6A supporting two beverage holders.

Figure 10B:
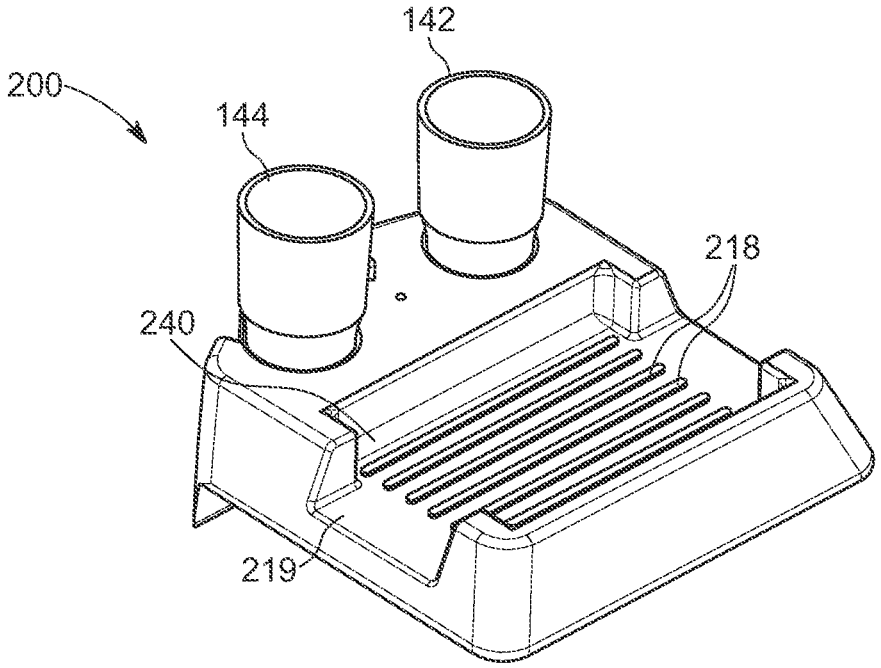

FIG. 10B is an upper rear right perspective view of FIG. 10A.

Figure 11:
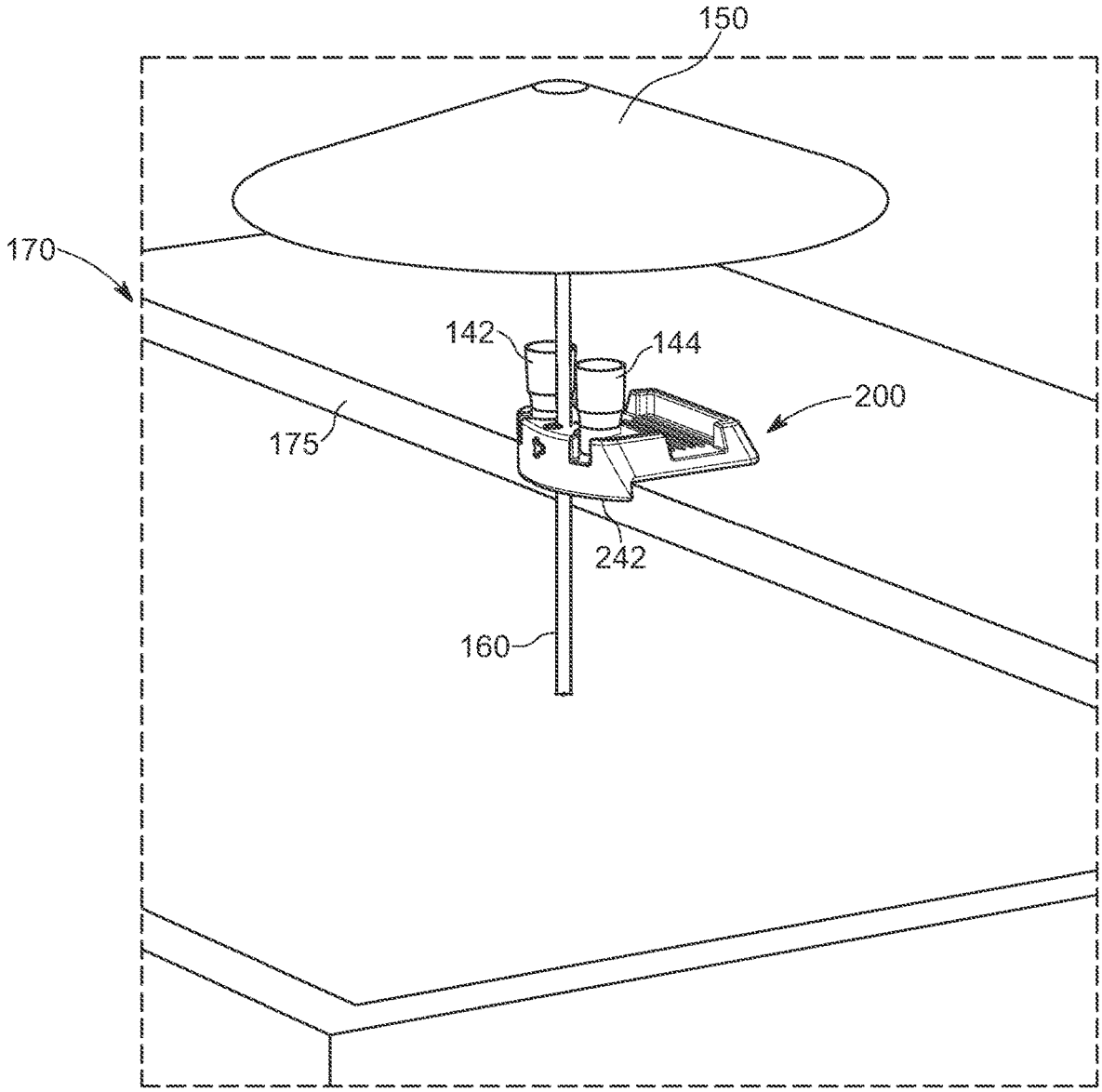

FIG. 11 is a perspective view of the stand with beverage containers of FIGS.

10A-10B supported on an edge of a swimming pool with an umbrella post clamped to the stand.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

A list of components will now be described.

100 First embodiment circular disc stand for supporting beverage holders and pool umbrella post
105 fill cap
110 upper disc member
112 front left indentation for beverage holder
113 rounded edge
114 right indentation of beverage holder
115 vertical through-hole for umbrella post
116 raised rim edge
118 raised ridges
120 lower disc member
122 front step member
123 rounded front edge
124 rear step edge
125 through-hole for umbrella post
130 clamping screw/knob
135 threaded stem member
137 horizontal through-hole
142 left beverage holder
144 right beverage holder
150 umbrella with canopy
160 umbrella post
170 swimming pool
175 inner edge of swimming pool
200 Second embodiment rectangular stand for supporting beverage holders and pool umbrella post
210 top
212 front left indentation for beverage holder
213 rounded front edge
214 right tops indentation of beverage holder
215 through-hole for umbrella post
217 flat angled sides
218 raised ridges
219 opposite facing cut outs
220 flat bottom
222 front step member
223 rounded front edge
224 rear step edge
225 through-hole for umbrella post
230 clamping screw/knob
235 threaded stem member
240 rectangular well

FIRST EMBODIMENT CIRCULAR STAND

FIG. 1A is an upper front perspective view of a first embodiment stand 100 for supporting beverage containers and a pool umbrella post. FIG. 1B is an upper rear perspective view of the stand 100 of FIG. 1A. FIG. 1C is an upper left perspective view of the stand 100 of FIG. 1A. FIG. 1D is an upper right perspective view of the stand 100 of FIG. 1A.

FIG. 2A is a lower front perspective view of the stand 100 of FIG. 1A. FIG. 2B is a lower rear perspective view of the stand 100 of FIG. 1A. FIG. 2C is a lower left perspective view of the stand 100 of FIG. 1A. FIG. 2D is a lower right perspective view of the stand 100 of FIG. 1A.

FIG. 3A is a front view of the stand 100 of FIG. 1A. FIG. 3B is a rear view of the stand 100 of FIG. 1A. FIG. 3C is a left side view of the stand 100 of FIG. 1A. FIG. 3D is a right side view of the stand 100 of FIG. 1A. FIG. 3E is a top view of the stand 100 of FIG. 1A. FIG. 3F is a bottom view of the stand 100 of FIG. 1A.

Referring to FIGS. 1A-3F, the stand 100 can have a generally circular disc shape with an outer diameter of approximately 15.99 inches, and be formed from molded plastic having two parts with an upper generally disc member 110 above a lower generally disc member 120.

The approximate overall dimensions of the base can be approximately 3.5 inches tall by approximately 16 inches in diameter.

The upper member 110 and the lower member 120 can be formed from injection molded plastic and the like, and be solid.

The upper member 110 and the lower member 120 can have a hollow interior, with a fill cap 105 to allow the stand to be filled with a ballast, such as water or sand. For example, pool water can be used to fill the hollow interior.

Alternatively, the upper member 110 and the lower member 120 can be solid molded form.

The upper disc member 110 can have a front left rounded indentation for supporting a beverage holder, and a front right rounded indentation for supporting a beverage holder. The upper surface of the upper disc member 110 can have a raised rim edge 116, and parallel raised ridges 118 that can form a gripping surface thereon. A round edge 113 can be circumferentially about the upper member 110.

A through-hole 115 in the upper disc member 110 can have a teardrop shape or oval shape or triangular shape therethrough.

The lower disc member 120 can have a similar diameter to the upper member 110 and thickness. The lower member 120 can have a front step member portion 122 with a rounded front edge 123, and a rear step edge 124. A through-hole 125 similar to the shape of through-hole 115 can pass through the lower member 120.

A clamping rotatable screw/knob 130 can have a threaded stem member 135 which passes through an exterior wall of a front side wall of the upper member 110 and lower member 120, and the threaded stem can pass through the generally horizontal through-hole 137 (FIGS. 2C-3F), which passes from an exterior of the front side wall through the molded base to the vertical through-hole. The generally horizontal through-hole 137 located above the step edge 122 on the front side wall 123, and below the upper surface 110 of the molded base. The end of the threaded stem 135 can enter into the vertical through-hole 115/125, and abut against the side of an umbrella post 160 (shown in FIG. 5 or shown in FIG. 11 referring to FIGS. 1C, 1D and 3C-3F. The end of the stem 135 is for locking the umbrella to the molded base.

FIG. 4A is an upper front left perspective view of the stand 100 of FIG. 1A supporting two beverage holders 142, 144. FIG. 4B is an upper rear right perspective view of FIG. 4A.

Referring to FIGS. 4A-4B, the stand 100 is shown supporting one beverage holder 142 in left indentation 112, and another beverage holder 144 in right indentation 114. Referring to FIGS. 1A-1D2, 2C, 2D, 3E, 4A and 4B, each of the indentations 112, 114, includes an arc shaped inner side wall and a side exterior opening which opens to an exterior of the molded base FIG. 5 is a perspective view of the stand 100 with beverage containers 142, 144 of FIGS. 4A-4B supported on an edge 175 of a swimming pool 170 with an umbrella post 160 clamped to the stand 100. The umbrella post 160 can have a umbrella canopy 150 thereon.

Referring to FIGS. 1A-5, the user can position the umbrella post 160 in the through-holes 115, 125 of the stand 100, so that the bottom of the umbrella post 160 can rest on the bottom of the pool 170, while the step edge 124 of the front step member 122 rests against the swimming pool edge 175.

In the first embodiment 100, the stand 100 can have a small portion 122 overhanging(cantilevered) over the edge 175 of the swimming pool 170, so that substantially most of the mass of the stand 100 is supported by the upper surface of the edge 175 of the swimming pool 170.

The clamping screw/knob 130 can be rotated so that the threaded stem 135 pushes one side of the umbrella post 160 into a narrow portion of the through-holes 115/125 to lock umbrella post 160 in place.

The upper raised ridges 118 on the stand 100 can be used as a nonslip surface to allow items, such as but not limited to smart phones, sunglasses, and the like to be supported on the stand 100.

SECOND EMBODIMENT RECTANGULAR STAND

FIG. 6A is an upper front perspective view of a second embodiment stand 200 for supporting beverage containers and a pool umbrella post. FIG. 6B is an upper rear perspective view of the stand 200 of FIG. 6A. FIG. 6C is an upper left perspective view of the stand 200 of FIG. 6A. FIG. 6D is an upper right perspective view of the stand 200 of FIG. 6A.

FIG. 7A is a lower front perspective view of the stand 200 of FIG. 6A. FIG. 7B is a lower left perspective view of the stand 200 of FIG. 6A. FIG. 7C is a lower right perspective view of the stand 200 of FIG. 6A.

FIG. 8A is a front view of the stand 200 of FIG. 6A. FIG. 8B is a rear view of the stand 200 of FIG. 6A. FIG. 8C is a left view of the stand of FIG. 6A. FIG. 8D is a right view of the stand 200 of FIG. 6A.

FIG. 9 is a top view of the stand 200 of FIG. 6A.

Referring to FIGS. 6A to 9, the stand 200 can have a generally rectangular configuration with a rounded front edge 213, and flat angled sides and rear wall 217. The top 210 can have a front left indentation 212 for supporting a beverage holder and front right indentation 214 for supporting another beverage holder. A through-hole 215 similar in shape to the through-holes 115/125 in the previous embodiment can pass from the top side through the bottom side of the stand 200. Opposite facing rectangular cut-outs 219 can pass through sides of the top side 210 of the stand 200. Raised parallel ridges 218 can on the top side, and function similar to the raised ridges 118 in the previous embodiment.

A clamping screw/knob 230 with threaded stem can pass through the rounded front edge 213 with an inner end that can press against the side of an umbrella post inserted into the through-hole 215.

The bottom of the stand 200 can have a generally flat bottom surface.

Under the rounded front edge 213 can be a front step member 222 with a rear step edge 224, which can work similar to the like members in the previous embodiment.

Stands 100/200 can have a hollow interior, with a fill cap 105 to allow the stand to be filled with a ballast, such as water or sand. Alternatively, the stands 100/200 can be formed from injection molded plastic and the like, and be solid.

FIG. 10A is an upper front left perspective view of the stand of 200 FIG. 6A supporting two beverage holders 142 and 144. FIG. 10B is an upper rear right perspective view of FIG. 10A.

Referring to FIGS. 10A-10B, beverage holders 142, 144 can be supported in the indentations 212, 214, and the raised ridges 218 can function as a similar nonslip surface similar to the ridges 118 in the previous embodiment.

FIG. 11 a perspective view of the stand 200 with beverage containers 142, 144 of FIGS. 10A-10B supported on an edge 175 of a swimming pool 170 with an umbrella post 160 clamped to the stand 200 by the clamping screw/knob 230.

In the second embodiment 200, the stand 200 can have a small portion 242 overhanging(cantilevered) over the edge 175 of the swimming pool 170, so that substantially most of the mass of the stand 200 is supported by the upper surface of the edge 175 of the swimming pool 170.

The clamping screw/knob 230 can be rotated so that the threaded stem 235 pushes one side of the umbrella post 160 into a narrow portion of the through-holes 215 to lock umbrella post 160 in place.

The upper raised ridges 218 on the stand 200 can be used as a nonslip surface to allow items, such as but not limited to smart phones, sunglasses, and the like to be supported on the stand 200.

The rectangular cut-out in the top of the stand can be used as a support for a portable cooler, such as but not limited to a portable cooler having a footprint of approximately 11.5 inches by approximately 8 inches.

Stands 100, 200 can be formed to be stackable on top of one another in order to reduce storage space and allow for ease in transport.

While the stands are described for use on an edge of a swimming pool, the stands can be used in other applications. For example, the stands can be positioned on the edges of outdoor tables, such as picnic tables, where the bottom of the umbrella post abuts the ground. Additionally, the stands can be place on tailgates of trucks to be used for tail gating, with the umbrella post abutting the ground. In these other applications the umbrella can also provide shade to those around it, and the stands can be used for supporting beverage holders, and portable coolers.

The term "approximately"/"approximate" can be +/−10% of the amount referenced. Additionally, preferred amounts and ranges can include the amounts and ranges referenced without the prefix of being approximately.

Although specific advantages have been enumerated above, various embodiments may include some, none, or all of the enumerated advantages.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A beverage tray and umbrella stand for use with an umbrella and a pool, comprising:

a molded base having upper surface and a lower surface, the molded base having a front side wall and a rear side wall, a lower surface of the front side wall having a rearwardly facing step edge;

a vertical through-hole passing from the upper surface to the lower surface of the front side wall for allowing a post of the umbrella to be supported therein, wherein the rearwardly facing step edge allows for supporting of the lower surface of the base beyond the rearwardly facing step edge to be adapted sit on an edge of a swimming pool;

a generally horizontal through-hole passing from an exterior of the front side wall through the molded base to the vertical through-hole, the generally horizontal through-hole being located above the rearwardly facing step edge on the front side wall, and below the upper surface of the molded base: and a rotatable knob with a threaded stem for passing through the generally horizontal through-hole, the stem has an end which is adaptable to abut against a post of the umbrella placed in the vertical through-hole for locking the umbrella to the molded base; and wherein the upper surface includes a plurality of generally circular indentations for supporting a plurality of beverage containers therein.

2. The beverage tray and umbrella stand of claim 1, wherein the vertical through-hole includes a tear drop configuration, so that an umbrella post is pushed into a narrow portion of the tear drop configuration by the threaded stem of the rotatable knob.

3. The beverage tray and umbrella stand of claim 1, wherein the vertical through-hole includes a triangular configuration, so that an umbrella post is pushed into a narrow portion of the tear drop configuration by the threaded stem of the rotatable knob.

4. The beverage tray and umbrella stand of claim 1, wherein the upper surface includes raised rib portions for allowing items to be supported therein without sliding off.

5. The beverage tray and umbrella stand of claim 4, further comprising:

opposite facing rectangular cut-outs that pass through side walls on the upper surface of the molded base.

6. The beverage tray and umbrella stand of claim 1, wherein the molded base includes: an upper generally disc shaped member and a lower generally disc shaped member.

7. The beverage tray and umbrella stand of claim 1, wherein the molded base is formed from a solid molded plastic.

8. The beverage tray and umbrella stand of claim 1, wherein the molded base has a hollow interior, and a fill cap for allowing the base member to be filled with at least one of a liquid or sand, as a ballast.

9. The beverage tray and umbrella stand of claim 1, wherein the molded base has a generally rectangular configuration.

10. The beverage tray and umbrella stand of claim 1, wherein the stand is configured to be stackable with an identical stand.

11. The beverage tray and umbrella stand of claim 1, wherein the upper surface includes:

a rectangular well indentation adapted for supporting a portable cooler thereon.

12. The beverage tray and umbrella stand of claim 1, wherein each of the generally circular indentations having an arc shaped inner side wall and a side exterior opening which opens to an exterior of the molded base, and the rotatable knob located in the front side wall between a pair of the generally circular indentations.

13. A beverage tray and umbrella stand for use with an umbrella and a pool, comprising:

a molded base having an upper surface and a lower surface, the molded base having a front side wall and a rear side wall, the upper surface having a plurality of indentations supporting at least one of a beverage container and a portable cooler thereon, the base having ballast;

a rearwardly facing step edge on the lower surface of a front side wall of the base, wherein the rearwardly facing step edge allows for supporting all most of the lower surface of the base beyond the rearwardly facing step edge over an edge of a swimming pool, with the ballast allowing the base to remain stable;

a vertical through-hole passing from the upper surface to the lower surface of the front side wall for allowing a post of the umbrella to be supported therein, the vertical through-hole includes an oblong configuration, with a narrow inner side portion, the oblong configuration being selected from a tear drop configuration and a triangular configuration;

a generally horizontal through-hole passing from an exterior of the front side wall through the molded base to the vertical through-hole; and a rotatable knob with a threaded stem passing into the generally horizontal through-hole, the threaded stem having an end for locking the post of the umbrella into the narrow inner side portion of the vertical through-hole in the molded base.

14. The beverage tray and umbrella stand of claim 13, wherein the plurality of indentations include generally circular indentations having an arc shaped inner side wall and a side exterior opening which opens to an exterior of the molded base, and the rotatable knob located in the front side wall between a pair of the generally circular indentations.

15. The beverage tray and umbrella stand of claim 13, further comprising:

raised rib portions on the upper surface for allowing items to be supported therein without sliding off; and opposite facing rectangular cut-outs that pass through side walls on the upper surface of the molded base.

* * * * *